US007048570B2

(12) United States Patent
Kubo et al.

(10) Patent No.: US 7,048,570 B2
(45) Date of Patent: May 23, 2006

(54) LOCKABLE ELECTRIC CONNECTOR

(75) Inventors: Tsukasa Kubo, Aichi (JP); Toshiaki Horii, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/499,726

(22) PCT Filed: Dec. 24, 2002

(86) PCT No.: PCT/JP02/13416

§ 371 (c)(1),
(2), (4) Date: Jun. 21, 2004

(87) PCT Pub. No.: WO03/056666

PCT Pub. Date: Jul. 10, 2003

(65) Prior Publication Data

US 2005/0075002 A1 Apr. 7, 2005

(30) Foreign Application Priority Data

Dec. 27, 2001 (JP) ..... 2001-397212

(51) Int. Cl.
*H01R 13/627* (2006.01)

(52) U.S. Cl. ..... 439/357; 439/655

(58) Field of Classification Search ..... 439/350–358, 439/655

See application file for complete search history.

(56) References Cited

FOREIGN PATENT DOCUMENTS

| | | | |
|---|---|---|---|
| JP | 62-136079 | U1 | 8/1987 |
| JP | 01-152474 | U1 | 10/1989 |
| JP | 02-113280 | U1 | 9/1990 |
| JP | 06-245348 | A1 | 9/1994 |
| JP | 09-102364 | A1 | 4/1997 |
| JP | 09-180821 | A1 | 7/1997 |
| JP | 11-260466 | A1 | 9/1999 |

OTHER PUBLICATIONS

PCT Response to PCT/JP02/13416 mailed on Nov. 4, 2003.
International Search Report for PCT/JP02/13416 mailed on Apr. 15, 2003.
International Preliminary Examination Report for PCT/JP02/13416 completed on Feb. 3, 2004.
English Translation of International Preliminary Examination Report (Date of mailing of translation Aug. 24, 2004).

*Primary Examiner*—Javaid H. Nasri
(74) *Attorney, Agent, or Firm*—Rader, Fishman & Grauer PLLC

(57) ABSTRACT

A lockable electric connector to be fitted and electrically connected to a socket provided on an outer face thereof with a rib extending in the insertion direction. The electric connector is provided with: a contact; a housing which has a fitting concave for receiving the socket, and which holds the contact such that a portion of the contact is exposed in the fitting concave; and a locking claw formed as projecting from the housing toward the upstream side in the socket insertion direction for holding the fitting state of the socket to the lockable electric connector. The locking claw has an engaging projection to be locked and engaged with an engaging portion of the socket, the engaging projection being formed at a position upstream with respect to the fitting concave in the socket insertion direction. The engaging projection has a guide groove for guiding the rib of the socket, the guide groove extending in the socket insertion direction.

3 Claims, 10 Drawing Sheets

LOCKABLE ELECTRIC CONNECTOR

RELATED APPLICATION

This Application corresponds to Japanese Patent Application No. 2001-397212 filed with the Japanese Patent Office on Dec. 27, 2001, the full disclosure of which is incorporated herein by reference.

BACKGROUND OF THE INVENTION

1. Field of the Invention

The present invention relates to an electric connector such as a relay connector for relaying sockets or a base connector disposed on a printed circuit board, the electric connector having locking claws for holding the fitting state of the socket(s) to the connector.

2. Description of Related Art

An electric connector fixed onto a printed circuit board is called a base connector, and a connector connected to the tips of wires or cables is called a socket. Further, a connector for relaying the connection between sockets, is called a relay connector.

For example, a mechanical apparatus having a plurality of functional units such as a vending machine, is provided with a plurality of units such as an illumination unit for illuminating the commercial products, a sensor unit for detecting coins and bills, a discharge unit for discharging a commercial product to the outlet slot, and the like. Since these units must electrically be cooperated with one another, it is inevitable to electrically connect these units to one another.

In this connection, each unit has a function module formed by mounting electric and electronic elements on a printed circuit board, and the function modules are connected to one another by a wire harness.

A wire harness is generally designed to be commonly used in a plurality of types of machines. However, machines of various types are different from one another in the positions of and the distances between function modules. Accordingly, there are instances where a socket connected to wires led out from the wire harness, can directly be connected to a base connector on a function module, but there are also instances where the length of the wires is too short. In the latter case, there is used an extension wiring provided at each end thereof with a socket. The one end of the extension wiring is connected to the base connector, while the other end is connected to the wire-harness-side socket through a relay connector.

Further, machines of a variety of types are different from one another in function module dividing manner. Accordingly, there are instances where it is required to branch the wires from a wire-harness-side socket to a plurality of function modules. On the other hand, there are instances where it is required to branch the wires from a single function module to two or more sockets at the wire harness side.

In such a case, the following measure is for example taken. That is, a socket connected to wires from the wire harness or a function module, is attached to a relay connector having pins of which number is the same as that of the socket, and the relay connector is connected to a plurality of sockets each having pins of which number is smaller than that of the relay connector.

The relay connector has post pins (contacts) to come in contact with contacts of a socket, and a housing which holds the post pins. The housing has (i) an engaging concave for receiving the socket and (ii) a locking claw arranged to lock and engage with the socket for securely holding the coupling state. The locking claw has an engaging projection at a position upstream with respect to the engaging concave in the socket insertion direction, the engaging projection being engaged with an engaging portion of the socket.

To prevent a socket from being erroneously inserted, the socket has ribs formed in the insertion direction, and the relay connector housing is provided in the engaging concave thereof with guide grooves to guide the ribs. Generally, a socket is provided on the top/underside and both lateral faces thereof with such ribs to securely prevent an erroneous insertion of the socket.

However, the ribs formed on outer faces (in particular on the lateral faces) of a socket, come in contact with the engaging projection of the locking claw of the relay connector, thus disadvantageously preventing a smooth insertion of the socket.

In particular, when intending to fit, to the relay connector, a socket having pins of which number is smaller than that of the relay connector, ribs of the socket come in contact with the engaging projection of the locking claw. This causes the socket to be inclined in posture with respect to the socket insertion direction. When intending to insert the socket thus inclined in posture, into the engaging concave of the relay connector, it is required to twist the socket with respect to the relay connector. This involves the likelihood that the post pins exposed in the engaging concave are disadvantageously deformed.

Further, even though it is tried to insert a socket in a wrong posture, the socket tip reaches the engaging concave of the relay connector. Accordingly, when the socket is particularly inclined in posture, the post pins may likely be deformed by the socket tip.

The relay connector is an example of the lockable electric connector. Such problems are also encountered with a base connector as another example of the lockable electric connector.

SUMMARY OF THE INVENTION

It is an object of the present invention to provide a lockable electric connector into which a ribbed socket can smoothly be inserted.

It is another object of the present invention to provide a lockable electric connector capable of preventing the contact from being damaged when connected to a socket.

The present invention relates to a lockable electric connector (1,10) to be fitted and electrically connected to a socket (S1, S11, S12, S21) provided on an outer face thereof with a rib extending in the insertion direction. The electric connector comprises: a contact (4); a housing (2) which has a fitting concave (24*a*, 24*b*, 24*c*, 24*d*) for receiving the socket, and which holds the contact such that a portion of the contact is exposed in the fitting concave; and a locking claw (3, 3A) formed as projecting from the housing toward the upstream side in the socket insertion direction for holding the fitting state of the socket to the lockable electric connector. The locking claw has an engaging projection (31) to be locked and engaged with an engaging portion of the socket, the engaging projection being formed at a position upstream with respect to the fitting concave in the socket insertion direction. The engaging projection has a guide groove (32, 321, 323, 324) for guiding the rib of the socket, the guide groove extending in the socket insertion direction. The alphameric characters in the parentheses represent the corresponding component elements in the embodiments to be discussed later. Of course, this does not mean that the present invention is construed as limited to these embodiments.

According to the arrangement mentioned above, the guide groove is formed in the engaging projection of the locking claw, and the socket rib passes through the guide groove in the course of fitting the socket into the fitting concave. Accordingly, the locking claw does not constitute barriers to the insertion of the socket. Further, guiding the rib by the guiding groove enables the socket to be smoothly guided, in a proper straight posture, into the fitting concave.

When the socket rib is formed at such position as to prevent erroneous insertion and the guide groove is formed at the position corresponding to the rib, the assembling operator can readily be aware of erroneous insertion if any. This securely protects the contact in the fitting concave from damages resulting from erroneous insertion.

Further, even though there is fitted a ribbed socket having pins in the number smaller than that of the pins of the electric connector, the rib and the engaging projection do not interfere with each other. This prevents the socket from being inclined with respect to the insertion direction. This securely prevents the contact from being damaged due to a twisting operation at the time of socket insertion.

The engaging projection is preferably arranged such that, in the course of fitting the socket into the fitting concave, the socket tip gets into the fitting concave before the engaging portion of the socket comes in contact with the engaging projection.

According to this arrangement, the guiding groove formed in the engaging projection of the locking claw can guide the socket such that the socket tip gets into the fitting concave. Thereafter, with the socket securely guided by the inner wall face of the fitting concave, the engaging projection of the locking claw can be engaged (locked) with the engaging portion of the socket. Thus, the socket can be maintained in a proper straight posture with respect to the fitting concave in the entire insertion process. This not only smoothly fits the socket into the fitting concave, causing the socket to be then locked, but also securely prevents the contact from being damaged.

The guide groove is preferably formed as passing through the engaging projection along the projecting direction of the engaging projection.

According to this arrangement, the locking claw can readily be resiliently deformed because the guide groove is formed as passing through the engaging projection. In view of product characteristics, the housing of the electric connector is made of an insulating material (resin material) having a high rigidity. However, the arrangement of the present invention enables the locking claw to be readily resiliently deformed. This reduces the force required for inserting the socket, thus contributing to improvements in working efficiency.

Preferably, the locking claw is disposed at each of the lateral sides of the housing in the socket insertion direction.

As to the guide groove formed in the locking claw, there maybe formed a single guide groove or a plurality of guide grooves.

These and other features, objects and advantages of the present invention will be more fully apparent from the following detailed description set forth below when taken in conjunction with the accompanying drawings.

DESCRIPTION OF THE PREFERRED EMBODIMENTS

Figure 1A:
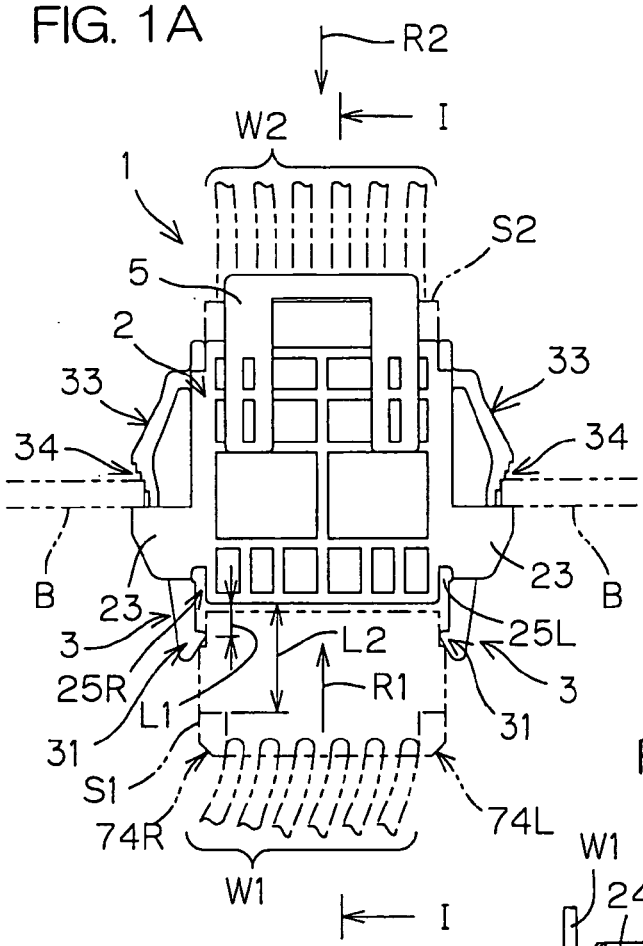
FIG. 1A is a plan view of a relay connector according to a first embodiment of the present invention.
Figure 1B:
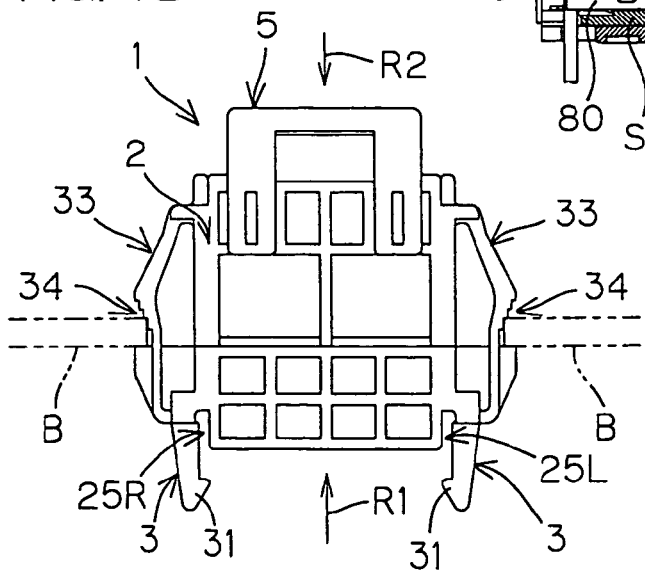
FIG. 1B is a bottom view of this relay connector.
Figure 1C:
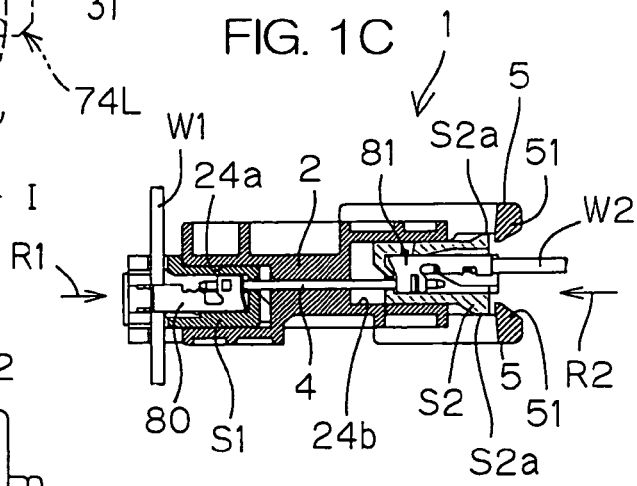
FIG. 1C is a section view taken along the line I—I in FIG. 1A.
Figure 2A:
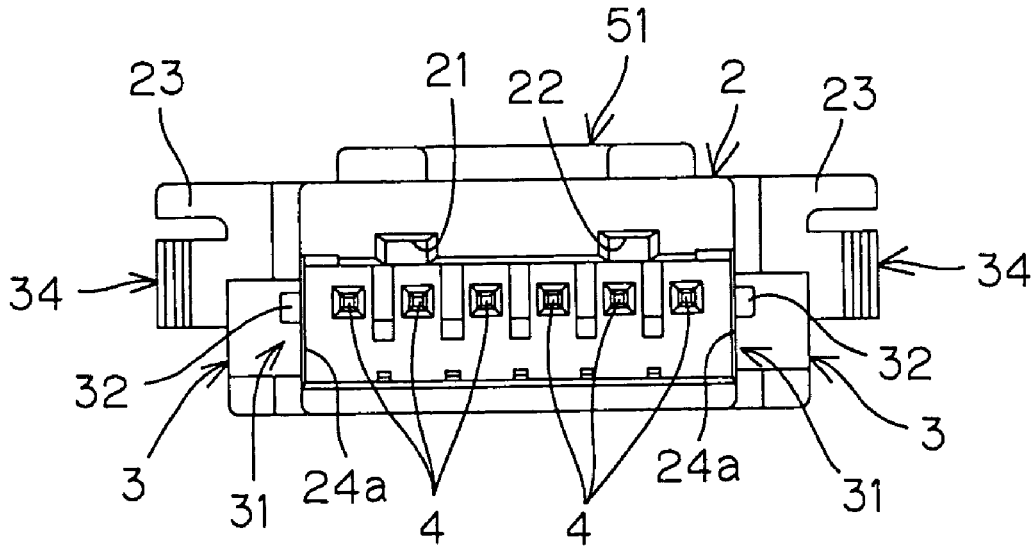
FIG. 2A is a front view of the relay connector shown in FIGS. 1A, 1B and 1C.
Figure 2B:
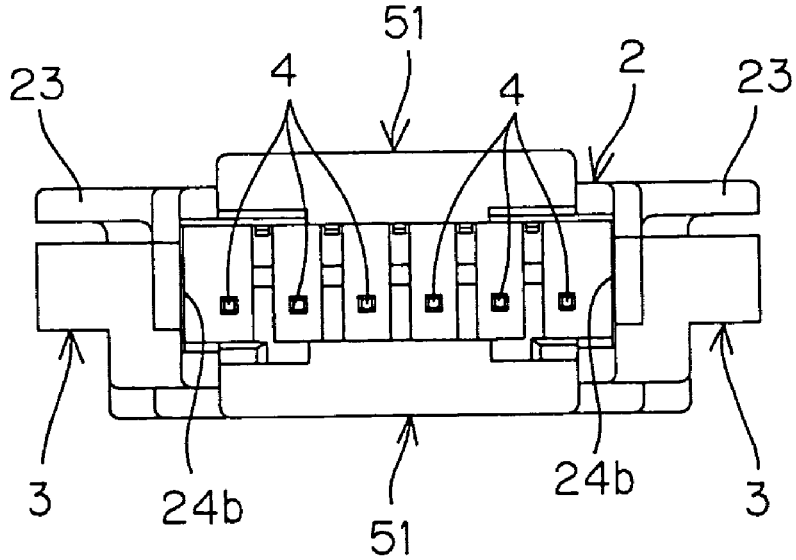
FIG. 2B is a back view of this relay connector.

FIG. 1A is a plan view of a relay connector 1 according to a first embodiment of the present invention, and FIG. 1B is a bottom view of this relay connector 1. FIG. 1C is a section view taken along the line I—I in FIG. 1A. FIG. 2A is a front view of the relay connector 1 viewed from a socket S1 side, and FIG. 2B is a back view of the relay connector 1 viewed from a socket S2 side.

The relay connector 1 is a connector for relaying and electrically connecting a pair of sockets S1, S2 mounted thereon. For example, one of the sockets S1, S2 is fixed to the ends of electric wires W1 forming a wire harness, and the other socket is fixed to ends of electric wires W2 forming extension wirings for connecting a base connector on a printed circuit board and the wire harness to each other. When the sockets S1, S2 are mounted on the relay connector 1, contacts 80, 81 of the sockets S1, S2 come in contact with both ends of post pins 4 of the relay connector 1 as shown in FIG. 1C. Thus, the electric wires W1 and the electric wires W2 are conducted to each other.

The relay connector 1 has a housing 2 formed by a molded article made of a highly rigid synthetic resin material (insulating material), and a plurality of post pins 4 (six pins in this embodiment) implanted in and fixed to the housing 2. The plurality of post pins 4 are disposed in parallel to one another, and their both ends are exposed in fitting concaves 24*a*, 24*b* formed in the housing 2. More specifically, the housing 2 has a pair of fitting concaves 24*a*, 24*b* at opposite positions in the direction of the post pins 4, and provision is made such that the sockets S1, S2 can be fitted into the fitting concaves 24*a*, 24*b*, respectively.

In association with the fitting concaves 24*a*, 24*b*, a pair of locking claws 3 and a pair of locking claws 5 are respectively formed for fixing the sockets S1, S2 to the housing 2. More specifically, the pair of locking claws 3 are formed in a unitary structure with the housing 2 and extend from both lateral sides of the fitting concave 24*a* toward the upstream side of the insertion direction R1 (parallel to the post pins 4) of the socket S1. The pair of locking claws 3 are provided at the tips thereof with engaging projections 31 which project in the mutually facing directions (in the inward directions). The engaging projections 31 are locked and engaged with engaging portions 74R, 74L of the socket S1. This causes the socket S1 to be locked with the housing 2, thereby to hold the fitting state of the socket S1.

On the other hand, the pair of locking claws 5 extend from the upper and lower portions of the fitting concave 24*b* toward the upstream side of the insertion direction R2 (parallel to the post pins 4) of the socket S2. The pair of locking claws 5 are provided at the tips thereof with engaging projections 51 which project in the mutually facing directions (in the inward directions). The engaging projections 51 are engaged with engaging portions S2*a* formed on outer faces of the socket S2. This causes the socket S2 to be locked with the housing 2, thereby to hold the fitting state of the socket S2.

At the both lateral sides of the fitting concave 24*a* for the socket S1, a pair of abutment portions 23 are projectingly formed in a unitary structure with the housing 2. The abutment portions 23 are arranged to come in contact with the peripheral portion of an opening formed in a partitioning plate B when the connector 1 is held as passing through the partitioning plate B. The locking claws 3 project from the abutment portions 23 toward the upstream side in the insertion direction R1. Stopper portions 33 are formed at the downstream side with respect to the abutment portions 23 in the insertion direction R1. The stopper portions 33 have an outwardly projecting curved shape and are resiliently deformable.

When the connector 1 is pushed along the insertion direction R1 and pressed into the opening formed in the partitioning plate B to cause the abutment portions 23 to come in contact with the peripheral portion of the opening, the stopper portions 33 are inwardly resiliently deformed and then restored to hold, together with the abutment portions 23, the peripheral portion of the opening in the partitioning plate B. Thus, the connector 1 is fixed as passing through the partitioning plate B. To be adaptive to a variety of thickness values of the partitioning plate B, the stopper portions 33 have stair configuration 34 at the side of the abutment portions 23.

Figure 3:
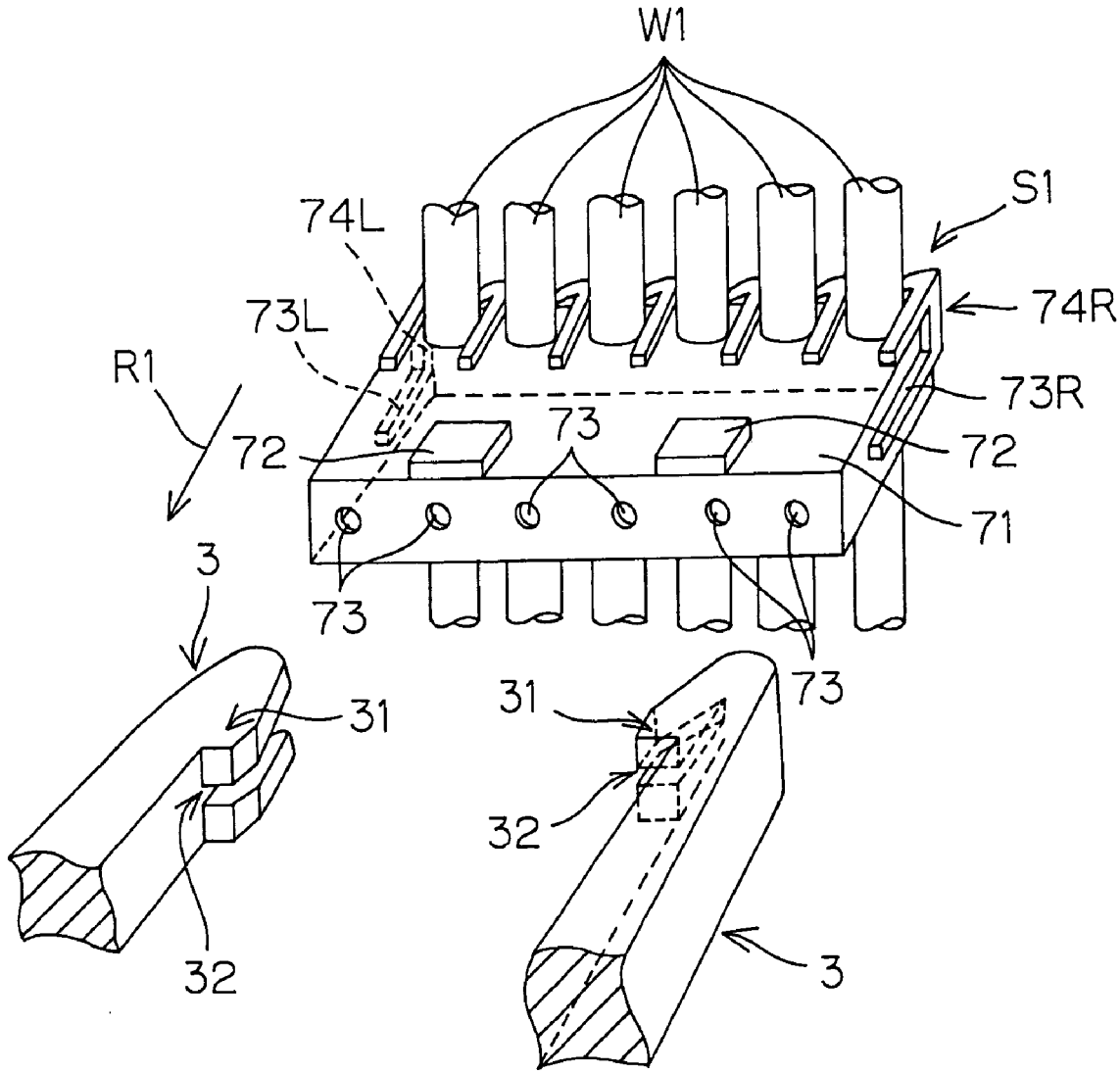
FIG. 3 is a perspective view of a socket mounted on the relay connector shown in FIGS. 1A, 1B and 1C.

FIG. 3 is a perspective view of the socket S1. The socket S1 has a housing 71 formed by a molded article made of a synthetic resin, and a plurality of contacts (for example six contacts) housed in the housing 71. The contacts are electrically connected to the electric wires W1 by pressure-contact for example. The housing 71 is made substantially in a flat rectangular parallelepiped. The housing 71 is provided, on its top edge portion at the downstream side in the insertion direction R1, with a pair of erroneous insertion preventing ribs 72 spaced apart from each other. Further, the housing 71 is provided on its lateral faces with erroneous insertion preventing ribs 73R, 73L extending in the insertion direction R1. Further, the housing 71 is provided, in its tip end face at the downstream side in the insertion direction R1, with a plurality of openings 73 (six openings in this embodiment). The openings 73 are arranged to receive the post pins 4 of the relay connector 1, enabling the post pins 4 to be electrically connected to the contacts inside of the housing 71.

The housing 71 is provided, on its both lateral sides at the upstream side with respect to the erroneous insertion preventing ribs 73R, 73L in the insertion direction R1, with engaging portions 74R, 74L which are locked and engaged with the engaging projections 31 of the locking claws 3 of the relay connector 1. The engaging portions 74R, 74L are formed in a unitary structure with the housing 71.

As best shown in FIG. 2A, the housing 2 of the relay connector 1 is provided, in the ceiling of the fitting concave 24*a*, with a pair of key grooves 21, 22 for receiving the pair of erroneous insertion preventing ribs 72. No such key grooves are formed in the bottom of the fitting concave 24*a*. Accordingly, when the socket S1 is tried to be inserted, with its upside turned down, into the fitting concave 24*a*, the erroneous insertion preventing ribs 72 come in contact with the inlet end face of the fitting concave 24*a*, thus preventing the socket S1 from being inserted.

The vicinity of the inlet of the fitting concave 24*a* is opened to both lateral sides such that the pair of erroneous insertion preventing ribs 73R, 73L get into gaps 25R, 25L (See FIG. 1A) formed between the locking claws 3 and the lateral sides of the housing 2. It is a matter of course that the fitting concave 24*a* has such inside configuration as to be matched with the tip portion of the housing 71 of the socket S1.

On the other hand, as best shown in FIG. 3, the locking claws 3 are provided in the engaging projections 31 thereof with guide grooves 32 extending in the insertion direction R. More specifically, the guide grooves 32 are formed at the positions corresponding to the erroneous insertion preventing ribs 73R, 73L. Thus, when mounting the socket S1 on the relay connector 1, the erroneous insertion preventing ribs 73R, 73L are guided by the guide grooves 32 and introduced to the fitting concave 24*a* in a proper straight posture.

The erroneous insertion preventing ribs 73R, 73L and the guide grooves 32 are formed as displaced with respect to the center in the vertical direction (which is perpendicular to both the insertion direction R1 and the facing direction of the pair of locking claws 3). Accordingly, when the socket S1 is tried to be inserted, with its upside turned down, into the relay connector 1, the tip end face (at the downstream side in the insertion direction R1) of the socket S1, comes in contact with the inlet end face of the fitting concave 24*a*, thus preventing the socket S1 from being inserted.

Figure 4A:
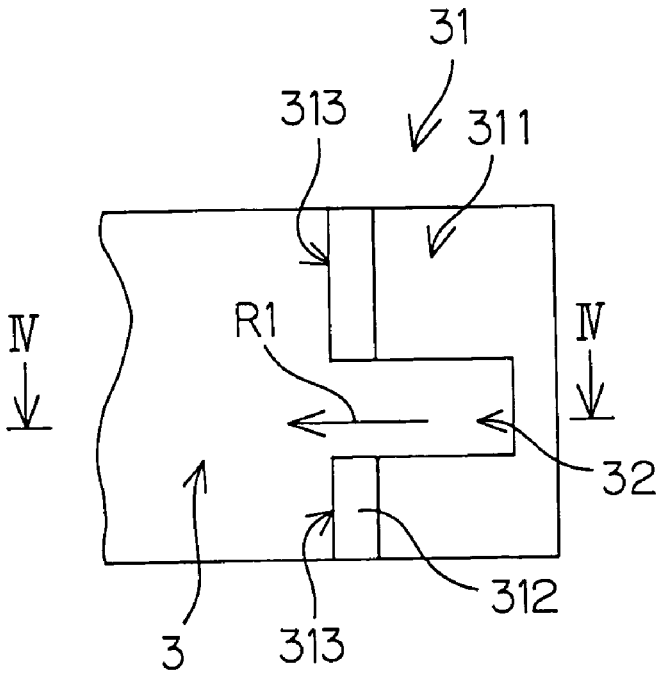
FIG. 4A is a side view illustrating the arrangement of the tip of a locking claw.
Figure 4B:
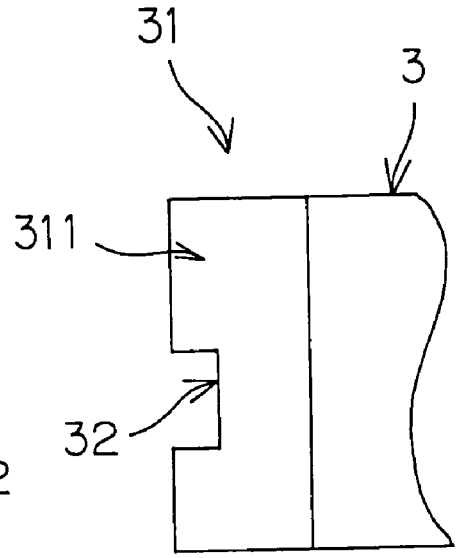
FIG. 4B is a front view of this locking claw.
Figure 4C:
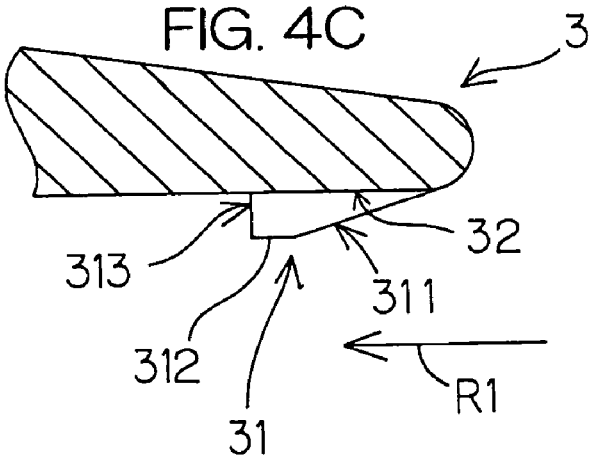
FIG. 4C is a section view taken along the line IV—IV in FIG. 4A.

FIG. 4A is a side view illustrating the arrangement of the tip of a locking claw 3, FIG. 4B is a front view of the locking claw 3 when viewed in the insertion direction R1, and FIG. 4C is a section view taken along the line IV—IV in FIG. 4A. The engaging projection 31 comprises: a guide face 311 inclined gradually inwardly toward the downstream side in the insertion direction R1; a flat face 312 extending from the guide face 311 in the insertion direction R1; and an engaging face 313 extending from the flat face 312 in the direction perpendicular to the insertion direction R1. The guide groove 32 has a depth, as measured from the flat face 312, substantially equal to the projecting amount of the erroneous insertion preventing ribs 73R, 73L. Further, the guide grooves 32 are formed as displaced with respect to the center of the width direction (which is perpendicular to the insertion direction R1 and extends along the flat face 312) of the engaging projection 31.

In the course of inserting the socket S1 into the relay connector 1, the erroneous insertion preventing ribs 73R, 73L of the socket S1 at its both lateral sides, are guided by the guide grooves 32. At this time, the tip of the socket S1 gets into the fitting concave 24*a* before the engaging portions 74R, 74L of the socket S1 come in contact with the guide faces 311 of the engaging projections 31. In other words, the engaging projections 31 (particularly the length of the locking claws 3), are arranged such that the distance L1 (See FIG. 1A) between the engaging projections 31 and the fitting concave 24*a*, is shorter than the distance L2 (See FIG. 1A) between the engaging portions 74R, 74L of the socket S1 and the tip end face thereof.

When an external force in the insertion direction R1 is further exerted to the socket S1 after the socket S1 tip portion gets into the fitting concave 24*a*, the engaging portions 74R, 74L of the socket S1 are guided by the guide faces 311 of the engaging projections 31. Then, the engaging portions 74R, 74L come in contact with the flat faces 312, and are finally engaged with the engaging faces 313. More specifically, the locking claws 3 are resiliently deformed to be outwardly expanded and spread, and the engaging portions 74R, 74L are moved after getting over the engaging projections 31. Then, the locking claws 3 are restored in shape, and the engaging faces of the engaging projections 31 are engaged with the engaging portions 74R, 74L. Thus, the socket S1 is locked as fitted into the relay connector 1.

According to the embodiment mentioned above, the socket S1 is maintained in a proper straight posture with respect to the fitting concave 24*a* during the whole process of insertion into the relay connector 1. Thus, there is no possibility of the socket S1 being twisted, thus preventing the post pins 4 of the relay connector 1 from being damaged. It is now supposed that the socket S1 is intended to be mounted, with its upside turned down, on the relay connector 1. At this time, the erroneous insertion preventing ribs 73R, 73L are guided by the guide grooves 32. Accordingly, the vertical positions of the socket S1 are shifted or displaced from the fitting concave 24*a* such that the tip end face of the socket S1 comes in contact with the peripheral edge of the fitting concave 24*a*. This causes the user to be aware of the fact of erroneous insertion, thus securely preventing the socket S1 from being erroneously inserted. Accordingly, there is no possibility of the post pins 4 being damaged due to erroneous insertion.

Figure 5A:
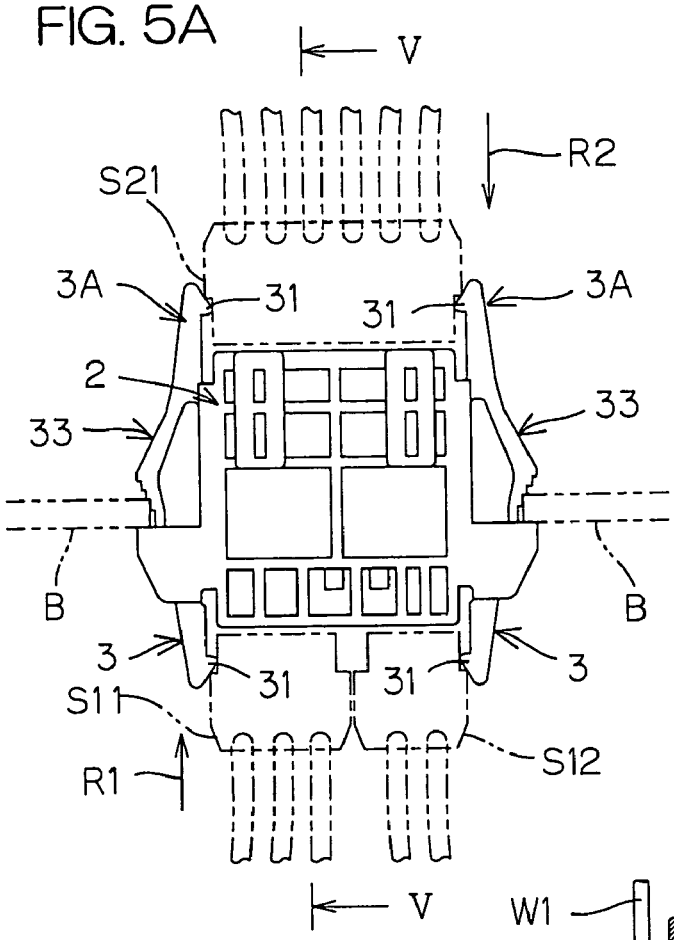
FIG. 5A is a plan view of a relay connector according to a second embodiment of the present invention.
Figure 5C:
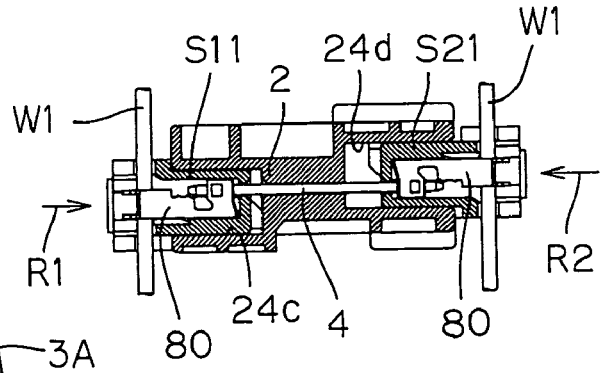
FIG. 5C is a section view taken along the line V—V in FIG. 5A.
Figure 5B:
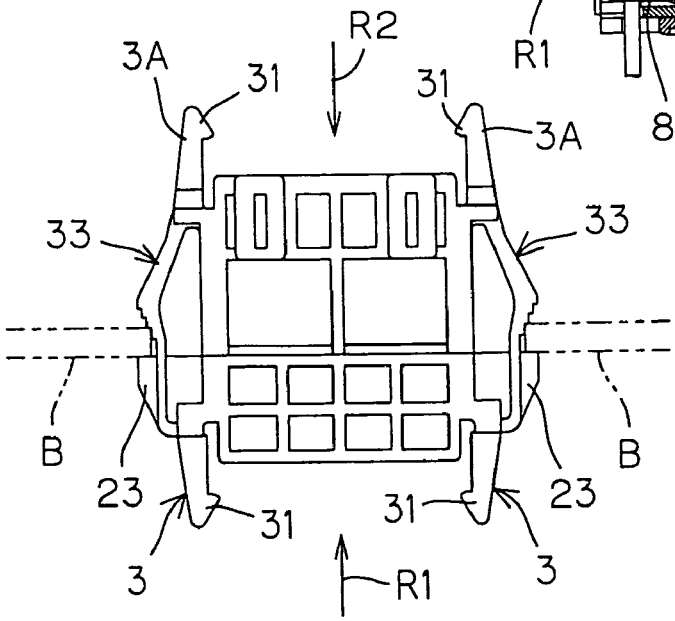
FIG. 5B is a bottom view of this relay connector.

FIG. 5A is a plan view of a relay connector 10 according to a second embodiment of the present invention, FIG. 5B is a bottom view of the relay connector 10, and FIG. 5C is a section view taken along the line V—V in FIG. 5A. In FIGS. 5A, 5B, 5C, like parts are designated by like reference numerals used in FIGS. 1A, 1B, 1C.

The relay connector 10 is provided in a housing 2 thereof with fitting concaves 24*c*, 24*d* in association with both ends of post pins 4. A pair of locking claws 3 project from both lateral sides of one fitting concave 24*c* toward the upstream side in the insertion direction R1, and a pair of locking claws 3A project from both lateral sides of the other fitting concave 24*d* toward the upstream side in the insertion direction R2. The locking claws 3, 3A have substantially the same arrangement.

More specifically, the locking claws 3, 3A are provided at the tips thereof with engaging projections 31 having guide grooves 32. The guide grooves 32 are formed as corresponding to erroneous insertion preventing ribs formed on lateral sides of sockets to be respectively fitted into the fitting concaves 24*c*, 24*d*. The engaging projections 31 are arranged such that, with the lateral-side erroneous insertion preventing ribs of the sockets guided by the guide grooves 32, the tips of the sockets reach the fitting concaves 24*c*, 24*d* before engaging portions of the sockets come in contact with the engaging projections 31.

Figure 6A:
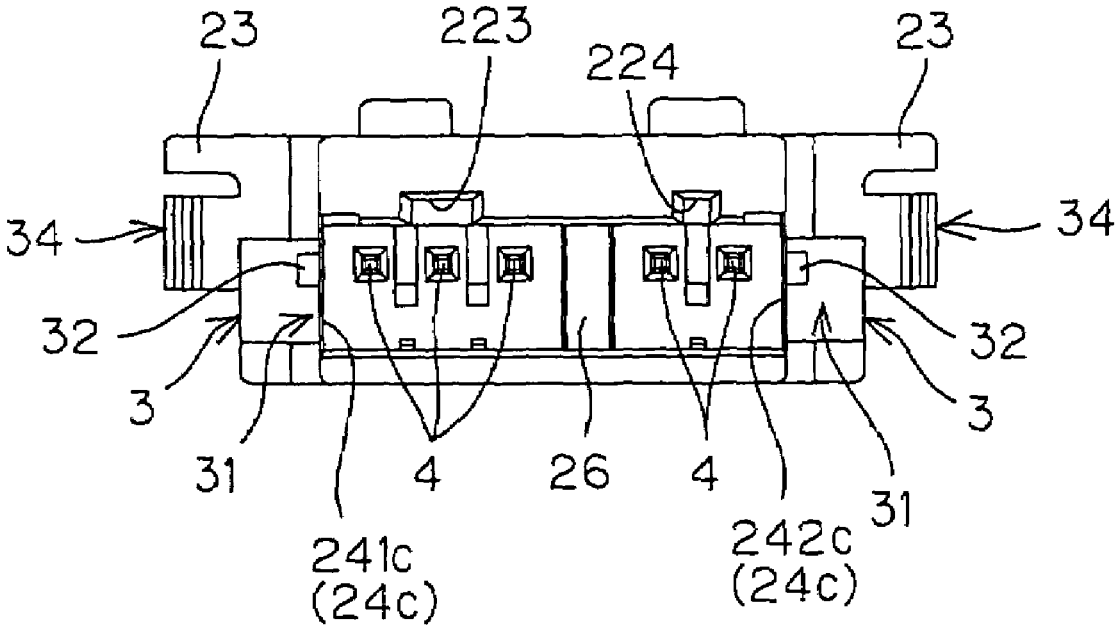
FIG. 6A is a front view of the relay connector shown in FIGS. 5A, 5B, 5C.
Figure 6B:
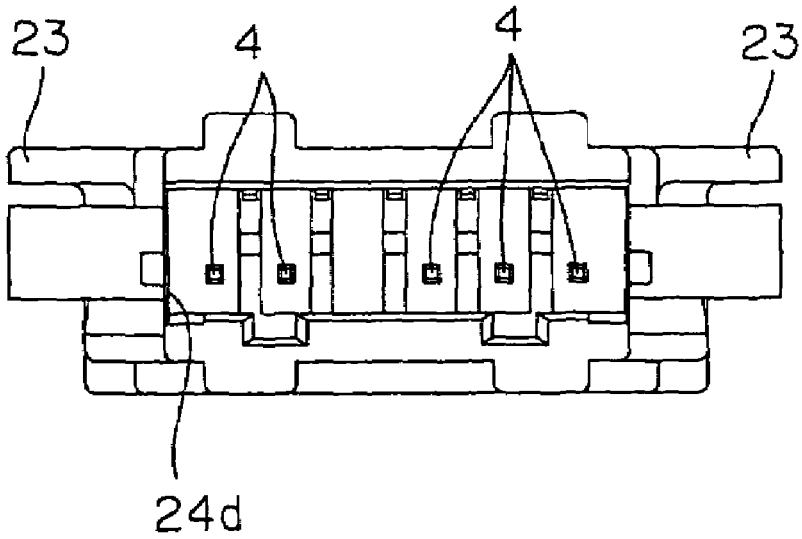
FIG. 6B is a back view of this relay connector.

FIG. 6A is a front view of the relay connector 10 viewed in the insertion direction R1, and FIG. 6B is a back view of the relay connector 10 viewed in the insertion direction R2. One fitting concave 24*c* is provided at the inner part thereof with a partition wall 26. Thus, the fitting concave 24*c* is divided into socket fitting concaves 241*c*, 242*c* into which a pair of sockets S11, S12 are respectively fitted. The arrangement in association with the other fitting concave 24*d* is similar to that of the fitting concave 24*b* of the relay connector 1 according to the first embodiment.

A predetermined number of post pins 4 (three post pins in this embodiment) are exposed in the socket fitting concave 241*c*, and a predetermined number of post pins 4 (two post pins in this embodiment) are exposed in the socket fitting concave 242*c*. Accordingly, the socket S11 of the 3-pin type can be fitted in the socket fitting concave 241*c*, and the socket S12 of the 2-pin type can be fitted in the socket fitting concave 242*c*.

Exposed in the fitting concave 24*d* are post pins 4 in the number (five in this embodiment) equal to the total number of the post pins exposed in the socket fitting concaves 241*c*, 242*c*. Accordingly, a socket S21 of the 5-pin type can be fitted into the fitting concave 24*d*.

Thus, the use of the relay connector 10 enables the wirings to be branched or to be integrated.

The fitting concaves 241*c*, 242*c* are provided in the ceiling portions thereof with key grooves 223, 224. These key grooves 223, 224 correspond to erroneous insertion preventing ribs formed on the tops of the sockets S11, S12. The erroneous insertion preventing ribs of the sockets S11, S12 are different from each other in width, and the key grooves 223, 224 are accordingly different from each other in width. This prevents the socket S12 from being erroneously fitted into the fitting concave 241*c*.

Figure 7B:
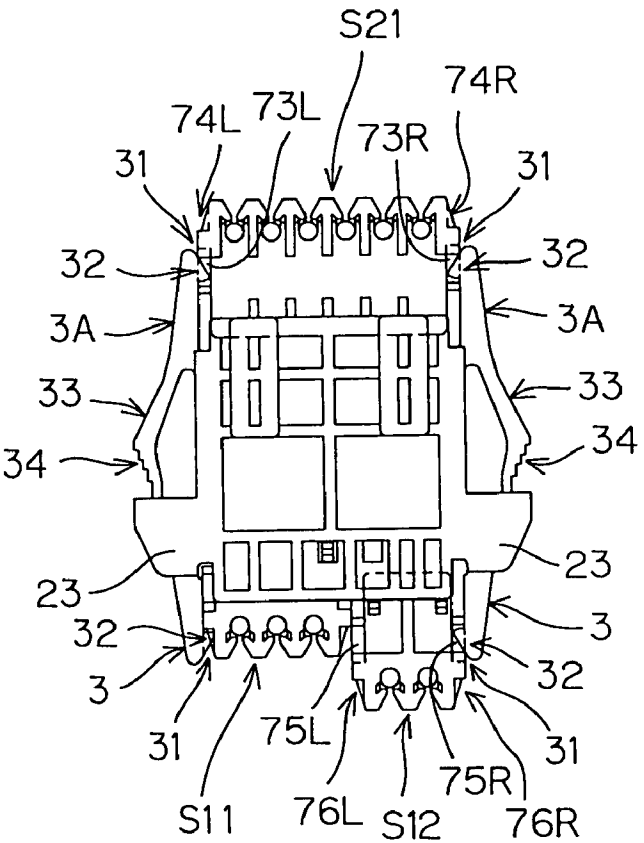
FIGS. 7A and 7B are plan views of the relay connector shown in FIGS. 5A, 5B, 5C, into which 2-pole and 6-pole sockets are inserted.
Figure 7A:
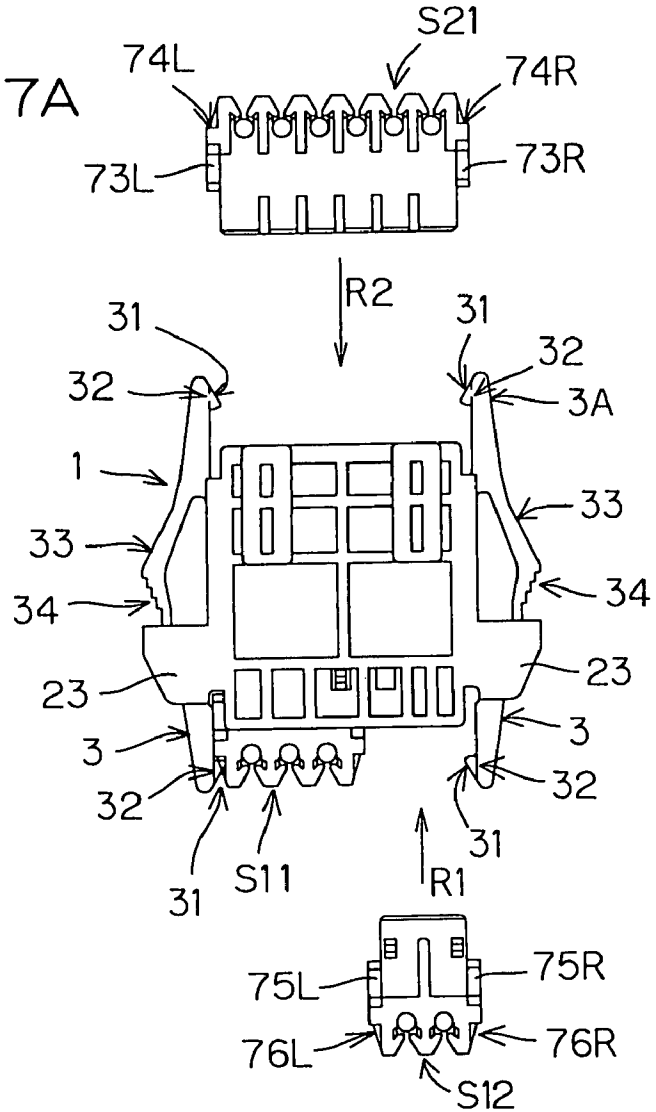

FIGS. 7A and 7B are plan views illustrating how the 2-pole socket S12 and the 6-pole socket S21 (in which five pins are actually used) are inserted into the relay connector 10. FIG. 7A shows the state before the sockets S12, S21 are inserted, while FIG. 7B shows the state in which the sockets S12, S21 are being inserted. The 3-pole socket S11 has already been fitted in the socket fitting concave 241*c*.

Each of the sockets S11, S12, S21 is a ribbed socket provided on the top or underside thereof with an erroneous insertion preventing rib. The sockets S12, S21 are further provided on the lateral sides thereof with erroneous insertion preventing ribs 75R, 75L; 73R, 73L. The sockets S12, S21 are further provided on the lateral sides thereof with engaging portions 76R, 76L; 74R, 74L to be engaged with the locking claws 3, 3A of the relay connector 10. The engaging portions 76R, 76L; 74R, 74L are made in a unitary structure with the sockets S11, S12 and are formed at the upstream side with respect to the erroneous insertion preventing ribs in the socket insertion direction.

When inserting the socket S12, its lateral-side erroneous insertion preventing rib 75R is guided by the guide groove 32 formed in the engaging projection 31 of the corresponding locking claw 3. The tip of the socket S12 gets into the socket fitting concave 242*c* before the engaging portion 76R of the socket S12 comes in contact with the engaging projection 31. Accordingly, the socket S12 is smoothly fitted in the socket fitting concave 242*c* while the socket S12 is always maintained in a proper straight posture with respect to the socket fitting concave 242*c* during the whole process of inserting the socket S12 into the relay connector 10. At this time, the erroneous insertion preventing rib 75R does not interfere with the corresponding engaging projection 31. This prevents the socket S12 from being inclined with respect to the socket fitting concave 242*c*.

The socket S21 is inserted in a manner similar to the manner mentioned above. That is, its lateral-side erroneous insertion preventing ribs 73R, 73L are guided by the guide grooves 32 of the engaging projections 31. The tip of the socket S21 gets into the fitting concave 24*d* before the engaging portions 74R, 74L of the socket S21 come in contact with the engaging projections 31. Accordingly, the socket S21 is smoothly fitted into the fitting concave 24*d* while the socket S21 is always maintained in a proper straight posture with respect to the fitting concave 24*d* during the whole insertion process.

In the foregoing, the description has been made of two embodiments of the present invention. However, the present invention can further be embodied in different manners. For example, FIGS. 8A, 8B, 8C; FIGS. 9A, 9B, 9C; and FIGS. 10A, 10B, 10C show another examples of the locking claw.

Figure 8A:
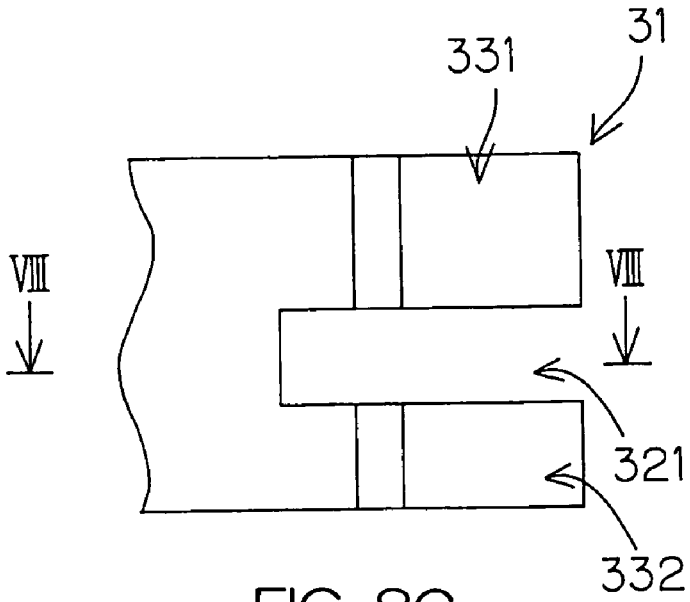
FIG. 8A is a side view of another example of the locking claw.
Figure 8B:
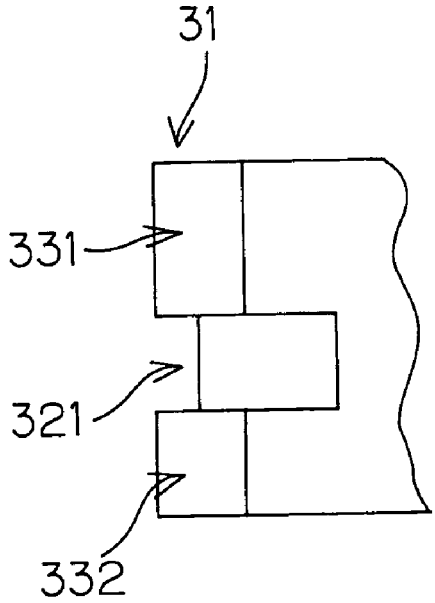
FIG. 8B is a front view of the locking claw viewed from its tip side.
Figure 8C:
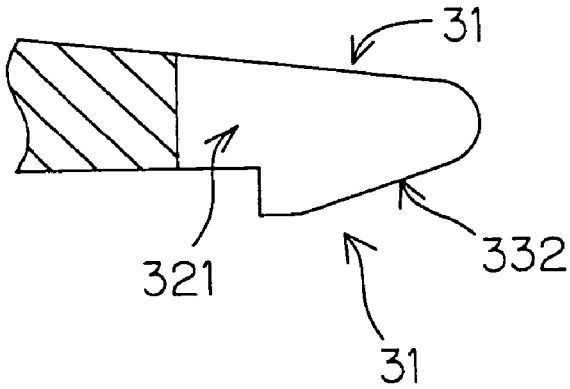
FIG. 8C is a section view taken along the line VIII—VIII in FIG. 8A.
Figure 9A:
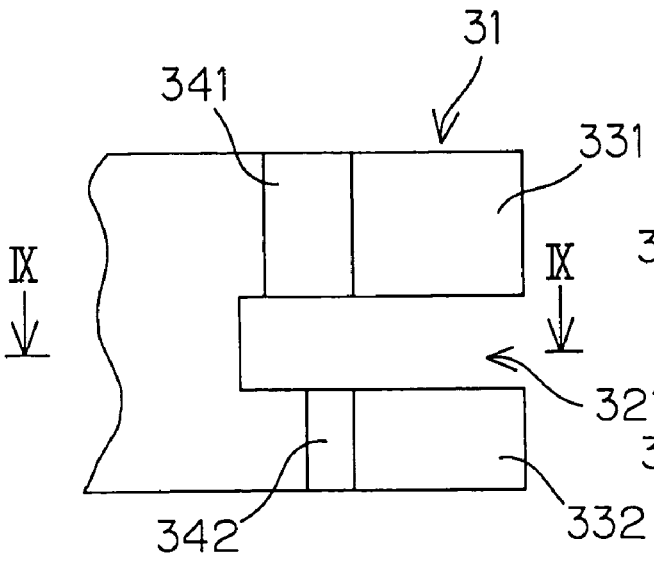
FIG. 9A is a side view of a further example of the locking claw.
Figure 9B:
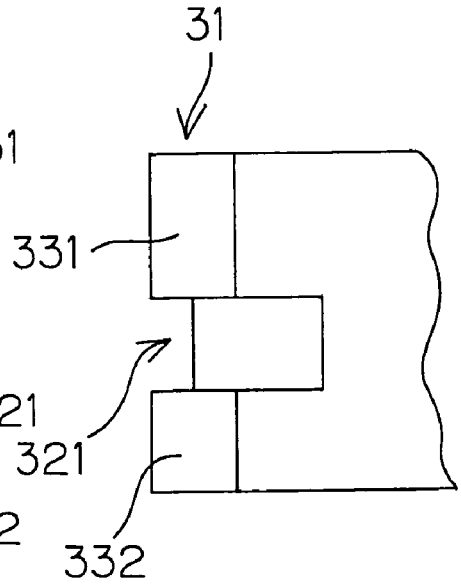
FIG. 9B is a front view of the locking claw viewed from its tip side.
Figure 9C:
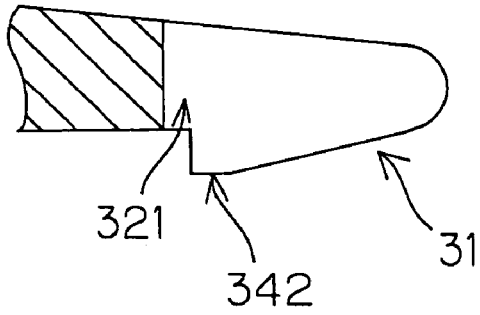
FIG. 9C is a section view taken along the line IX—IX in FIG. 9A.

In the locking claw in FIGS. 8A, 8B, 8C, an engaging projection 31 formed at the tip of the locking claw, has a guide groove 321 passing through the locking claw in a direction perpendicular to the socket insertion direction (the projection direction of the engaging projection 31). This forms, at the tip of the locking claw, two-forked engaging projections, i.e., a wider engaging projection 331 and a narrower engaging projection 332.

As shown in FIGS. 9A, 9B, 9C, engaging projections 331, 332 may have flat contact faces 341, 342 different from each other in width, the flat contact faces 341, 342 being arranged to come in slide contact with the lateral sides of a socket when the ribs on the socket lateral sides are fitted in the guide grooves.

Figure 10A:
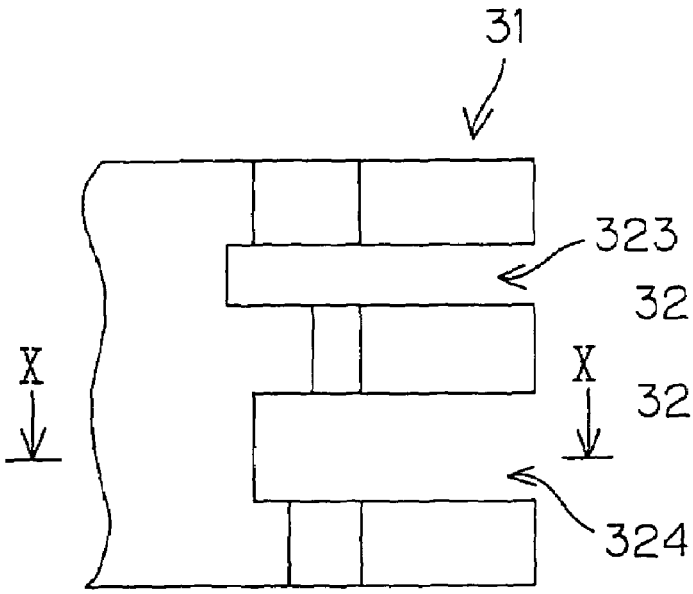
FIG. 10A is a side view of still another example of the locking claw.
Figure 10B:
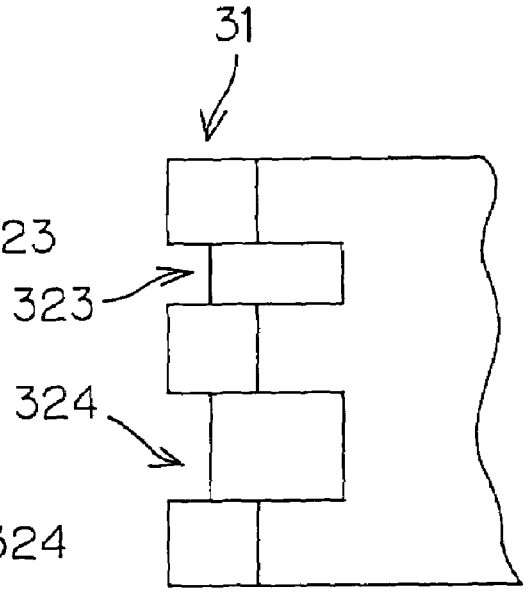
FIG. 10B is a front view of the locking claw viewed from its tip side.
Figure 10C:
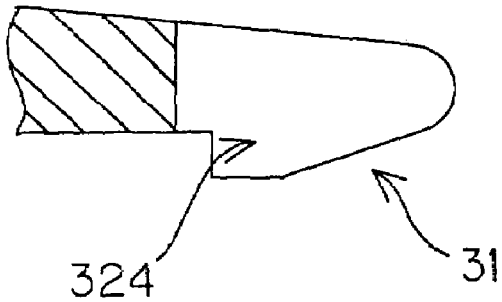
FIG. 10C is a section view taken along the line X—X in FIG. 10A.

As shown in FIGS. 10A, 10B, 1C, a plurality of guide grooves 323, 343 may be formed in an engaging projection 31.

According to the arrangement in FIGS. 8A, 8B, 8C; FIGS. 9A, 9B, 9C; or FIGS. 10A, 10B, 10C, the guide grooves for guiding erroneous insertion preventing ribs of a socket, are formed as passing through the tips of the locking claws. Accordingly, even though the housing and locking claws are made of a resin material having a high rigidity, the locking claws can readily be resiliently deformed. This reduces the force required for inserting the socket, thus contributing to improvements in working efficiency.

In the embodiments above-mentioned, the description has been made of the arrangement in which sockets provided on both lateral sides thereof with ribs, are inserted into the fitting concaves 24*a*, 24*b*; 24*c*, 24*d*. However, when the ribbed sockets S11, S12 having pins in the number smaller than the number of the post pins 4 of the relay connector, are inserted into the fitting concave 24*c* as in the second embodiment, there may be used sockets provided on one lateral side only thereof with ribs. In the above-mentioned embodiments, the description has been made of the arrangement in which two locking claws having the same shape form each pair of locking claws 3, 3A disposed at both lateral sides of the housing 2. However, two locking claws different from each other in shape may form a pair of locking claws.

The present invention may be applied to not only a relay connector, but also a base connector fixed to a printed circuit board.

Embodiments of the present invention have been discussed in detail, but these embodiments are mere specific examples for clarifying the technical contents of the present invention. Therefore, the present invention should not be construed as limited to these specific examples. The spirit and scope of the present invention are limited only by the appended claims.

This Application corresponds to Japanese Patent Application No. 2001-397212 filed with the Japanese Patent Office on Dec. 27, 2001, the full disclosure of which is incorporated herein by reference.

What we claim is:

1. A lockable electric connector adapted to be fitted and electrically connected to a socket provided on an outer face thereof with a rib extending in a socket insertion direction, comprising:

a contact in a form of a pin having a first pin portion and a second pin portion;

a housing having a fitting concave for receiving the socket, the housing formed to surround and contact the first pin portion in a manner to hold the contact in a stationary state in the housing with the second pin portion projecting into the fitting concave; and a locking claw projecting from the housing toward an upstream side in the socket insertion direction for holding the socket in the fitting concave in a fixed state, the locking claw having an engaging projection operative to be locked and engaged with an engaging portion of the socket, the engaging projection formed at a position upstream with respect to the fitting concave in the socket insertion direction, the engaging projection having a guide groove for guiding the rib of the socket, the guide groove extending in the socket insertion direction.

2. A lockable electric connector according to claim 1, wherein the engaging projection is arranged such that, when fitting the socket into the fitting concave, the socket tip is inserted into the fitting concave before the engaging portion of the socket comes in contact with the engaging projection.

3. A lockable electric connector according to any of claims 1 and 2, wherein the guide groove passes through the engaging projection along a projecting direction of the engaging projection.

* * * * *